US012208873B2

(12) United States Patent
Weigle

(10) Patent No.: US 12,208,873 B2
(45) Date of Patent: Jan. 28, 2025

(54) COLLAPSABLE TRANSOM FOR INFLATABLE RAFT

(71) Applicant: Marcus Weigle, Spring Valley, CA (US)

(72) Inventor: Marcus Weigle, Spring Valley, CA (US)

(73) Assignee: Marcus Weigle, Spring Valley, CA (US)

( * ) Notice: Subject to any disclaimer, the term of this patent is extended or adjusted under 35 U.S.C. 154(b) by 391 days.

(21) Appl. No.: 17/707,075

(22) Filed: Mar. 29, 2022

(65) Prior Publication Data

US 2023/0312066 A1 Oct. 5, 2023

(51) Int. Cl.

| | |
|---|---|
| ***B63C 9/23*** | (2006.01) |
| ***B63B 7/08*** | (2020.01) |
| ***B63C 9/02*** | (2006.01) |
| ***B63C 9/04*** | (2006.01) |

(52) U.S. Cl.

CPC ..... *B63C 9/23* (2013.01); *B63B 7/085* (2013.01); *B63C 9/02* (2013.01); *B63C 2009/042* (2013.01)

(58) Field of Classification Search

CPC ..... B63C 9/23; B63C 9/02; B63C 2009/042; B63B 7/085

See application file for complete search history.

(56) References Cited

U.S. PATENT DOCUMENTS

2005/0076820 A1* 4/2005 Fleming ..... B63B 17/02 114/245
2007/0295255 A1* 12/2007 Stryjewski ..... B63B 35/34 114/352
2011/0265702 A1* 11/2011 Kaye ..... B63B 7/082 248/642

OTHER PUBLICATIONS

[No. Author Listed] "Intex® Owner's Manual Inflatable Boat," Intex Marketing Ltd.—Intex Development Co. Ltd.—Intex Recreation Corp., May 31, 2022, 14 pages.

tiendakayak.com [Online], "Oru Kayak: Assembly Guide," Updated on or before May 9, 2023 [Retreived on May 9, 2023], retrieved from: URL<https://www.tiendakayak.com/images/kayaks-origami-2016_1.pdf>, 20 pages.

* cited by examiner

*Primary Examiner* — Stephen P Avila
(74) *Attorney, Agent, or Firm* — Fish & Richardson P.C.

(57) ABSTRACT

A collapsible transom for an inflatable raft has a front section including two parallel front struts and a rear section including a floor portion and a collapsible support portion. The floor portion includes two parallel rear struts, and the two parallel front struts and two parallel rear struts are slidably connectable to each other by insertion into tubular end portions. The support portion is pivotally connected to the floor portion and movable between an expanded position with the support portion substantially parallel to and spaced away from the floor to a collapsed position with the support portion adjacent the floor.

20 Claims, 3 Drawing Sheets

COLLAPSABLE TRANSOM FOR INFLATABLE RAFT

TECHNICAL FIELD

This invention relates to inflatable rafts, and more particularly to a collapsible transom to provide rigid reinforcement for an inflatable raft.

BACKGROUND

Inflatable rafts are used for fishing, camping, cruising, and the like. A typical inflatable raft includes side walls that extend in an oval or U-shape and a deck floor extending between the side walls. Inflation can provide some degree of rigidity to the raft. However, due to the flexible nature of the material, e.g., plastic, the deck floor may not be a stable surface, e.g., not be suitable for standing. Therefore in some cases a transom is used to provide a used to provide a rigid floor or otherwise increase the rigidity of the raft.

SUMMARY

In one aspect, a collapsible transom for an inflatable raft has a front section including two parallel front struts and a rear section including a floor portion and a collapsible support portion. The floor portion includes two parallel rear struts, and the two parallel front struts and two parallel rear struts are slidably connectable to each other by insertion into tubular end portions. The support portion is pivotally connected to the floor portion and movable between an expanded position with the support portion substantially parallel to and spaced away from the floor to a collapsed position with the support portion adjacent the floor.

Advantages may include one or more of the following. The transom provides a stable platform so a user can stand with confidence, as well as an integrated seat/transom support structure beneath which a fuel tank or battery can be stored. As a result, the transom can improve the functionality and usability of the raft. Moreover the transom is collapsible and can fit into the trunk of a car, and is thus easily transportable. The transom is configured to avoid damage to the inflatable raft, is adjust to various size rafts, and is extremely light weight.

The details of one or more embodiments are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

As noted above, a transom can be used to provide a used to provide a rigid floor or otherwise increase the rigidity of an inflatable mop. However, currently available transoms are often difficult to install in the raft, difficult to assemble, may useable for only a particular brand of raft based on the size of the raft, and bulky and difficult to transport. However, some configurations for a collapsible transom can both provide a stable platform when in an expanded state, but be easy to transport when in a collapsed state.

Figure 1:
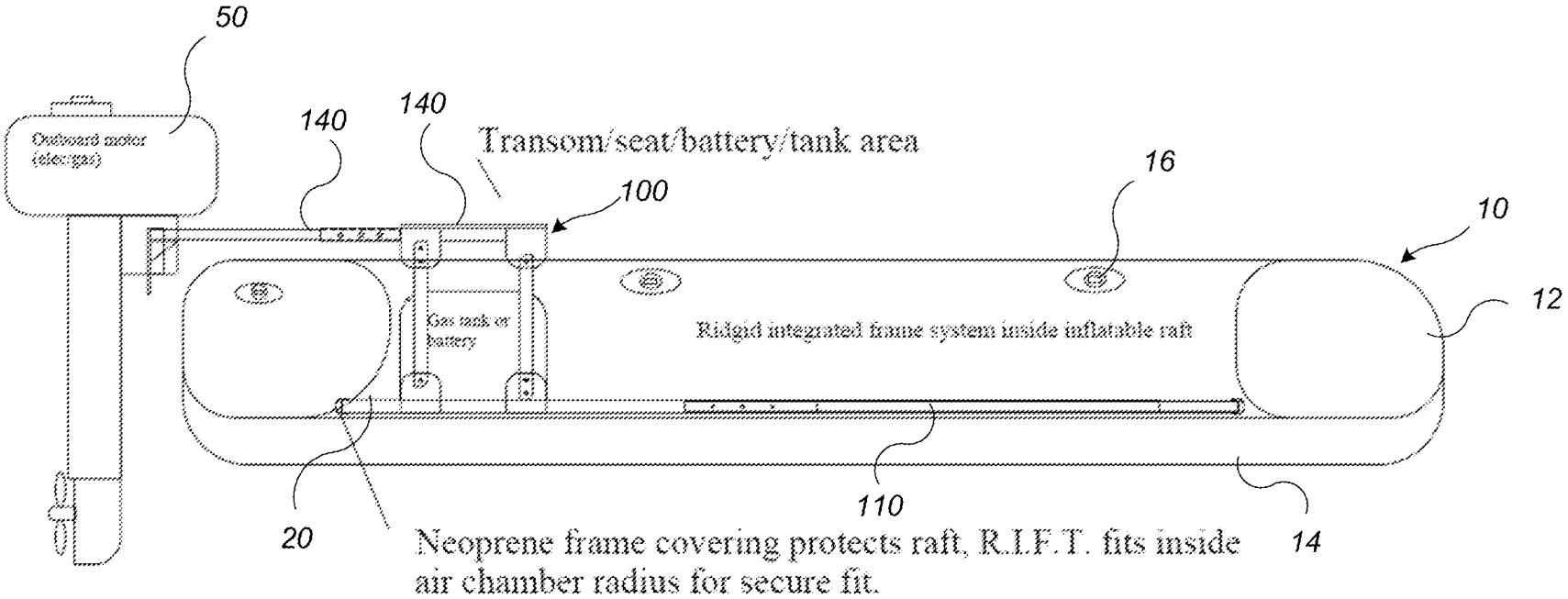
FIG. 1 is a schematic cross-sectional side view of a raft with a transom installed.

Referring to FIG. 1, an inflated raft 10 includes a deck floor 14 and side walls 12 extending up from edges of the deck floor 14. The side walls 12 can form a rectangular or oval shape. The side walls 12 can have one or more handles 16 or grommets for a grab rope.

A transom 100 is shown installed in the raft 10. The transom 100 includes a floor portion 110 and a support portion 120 collapsibly connected to the floor portion 110. An outboard motor 50 can be secured to an end of the support portion 140 that projects past the aft side wall of the raft 10.

Figure 2:
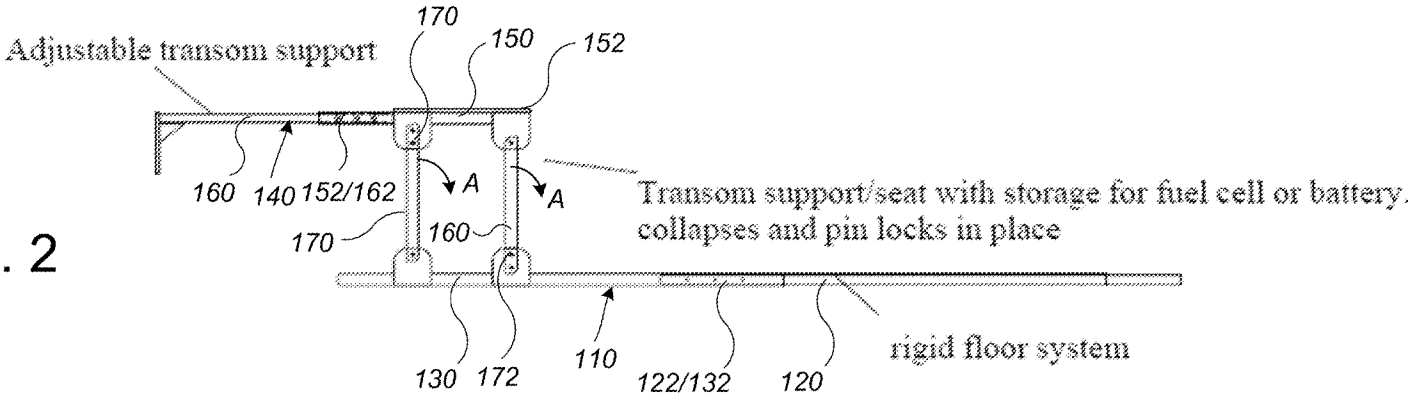
FIG. 2 is a schematic side view of the transom.
Figure 3B:
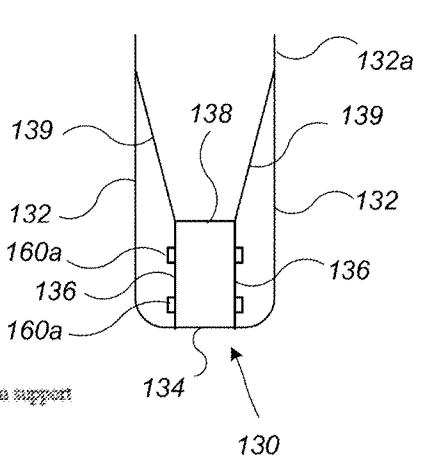
FIG. 3B is a schematic top view of the rear section of the floor portion of the transom.
Figure 3:
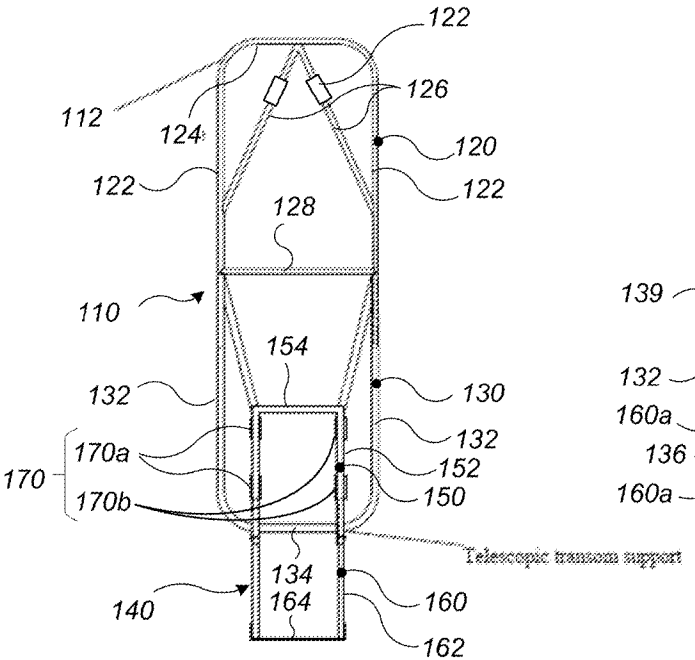
FIG. 3 is a schematic top view of the transom.

FIGS. 2 and 3 illustrate the transom 100 in more detail. The various part of the transom can be formed of an aluminum frame, e.g., a lightweight 6061-TG aluminum alloy. In addition, at least portions of the frame that would contact the raft can be coated with a neoprene coating to reduce the danger of damage to the plastic material of the raft.

Figure 3A:
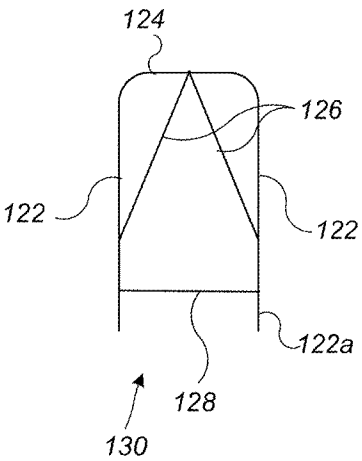
FIG. 3A is a schematic top view of the front section of the floor portion of the transom.

Overall, the floor portion 110 of the transom 100 forms a rectangular perimeter with curved edges 112. In particular, referring to FIGS. 3 and 3A, the floor portion 110 includes a front section 120 that is detachably securable to a rear section 130. The front portion 120 includes two parallel struts 122 that are connected at the front edge by a perpendicular fore strut 124. A cross-strut 128 can connect the two parallel struts 122 near, e.g., about 1-2 feet, the aft ends the parallel struts 122. In addition, two support struts 126 can be secured to and extend diagonally from a mid-point of fore strut 124 to the two parallel struts 122. Each support strut 126 can be connected to its respective parallel strut 122 at a point about ⅓ of the length from the cross-strut 138 and the fore strut 124.

In some implementations, one or more struts of the front section 120, e.g., the support struts 126, can include tabs that provide or to which a stanchion of swivel chair can be mounted.

Turning to FIGS. 3 and 3B, the rear section 130 of the floor portion 110 is somewhat similar to the front section, and includes an outer frame portion with two parallel struts 132 that are connected at the rear edge by a perpendicular aft strut 134. The rear section 130 also includes an inner frame portion with two parallel struts 136 that are spaced inwardly from the outer struts 132 and that are connected to the aft strut 134. The two parallel struts 136 of the inner frame are connected at their forward end by a cross-strut 138. In addition, two support struts 139 can be secured to and extend diagonally from the corners of the inner frame, i.e., where the two parallel struts 136 connect to the cross-strut 138, to the two parallel struts 132. Each support strut 139 can be connected to its respective parallel strut 132 at a point about ⅓ near the end of the two parallel struts 132, e.g., about 1-2 feet from the front end of the respective struts 132.

To connect the front section 120 to the rear section 130, end portions 132*a* of the parallel struts 132 can slide into tubular end portions 122*a* of the parallel struts 122 (or vice versa with end portions of the front struts 122 fitting into tubular end portions of the rear struts 132). Screws can then fit into screw-holes through both end portions 122*a*, 132*a* to secure the front section 120 to the rear section 130. Alternatively, the end-portions 132*a* of the struts 132 include spring loaded pins that will fit into receiving holes in the end portions 122*a* of the struts 122 to lock the struts in place. The pins can then be depressed to unlock and permit the struts 122, 132 to be separated.

Returning to FIG. 1, the fore and aft ends of front and rear sections 120, 130, respectively, can fit into gaps between the rounded side walls 12 and the deck floor 14 of the raft 10. In particular, the floor portion of the transom can be placed on the deck floor of the raft and then expanded to have a tight fit against the side wall 12, thus providing good rigidity and stability. This also permits the transom to be adjustable for rafts of different lengths.

Referring to FIGS. 2 and 3, the transom support portion 140 also includes a front section 150 and a rear section 160 that are slidably connected and which together form rectangular perimeter. The front section 150 includes two parallel struts 152 connected that are connected at the front edge by a perpendicular fore strut 154. In addition, a cover 152 can be secured and supported on front section 150 by the struts 152. Similar to the front section, the rear section 160 includes two parallel struts 162 connected that are connected at the front edge by a perpendicular aft strut 164. The aft strut 164 can include appropriate holes or shapes to permit connection of an outboard motor (see FIG. 1).

To slidably connect the front and rear sections 150, 160, end portions of 152*a* of the two parallel struts 162 can slide into tubular end portions 162*a* of the parallel struts 162. This permits the support portion 140 to be telescopically extendible, so that the support is adjustable for rafts with sidewalls of different width or outboard motors that require different spacing. Screws or pins can fit into holes through both end portions 152*a*, 162*a* to secure the front section 150 to the rear section 160 at a desired length.

As noted above, the support portion 140 is collapsibly connected to the floor 110. For example, four parallel connecting struts 170 (two connecting struts can be seen in the side view of FIG. 2) can each have one end pivotally connected to the support portion 140 and the other end pivotally connected to the floor 110. In particular, two connecting struts 170*a* can each have one end pivotally connected to one of the parallel struts 136 of the inner frame of the rear section 130 of the floor 110 and the other end pivotally connected to one of the parallel struts 152 of the front portion 150 of the support portion 140. Similarly, two connecting struts 170*b* can each have one end pivotally connected to another of the parallel struts 136 of the inner frame of the rear section 130 of the floor 110 and the other end pivotally connected to another of the parallel struts 152 of the front portion 150 of the support portion 140. The connecting struts can be pivotally connected to flanges that are screwed or bolted to the struts of the floor 110 and support portion 140.

Figure 4:
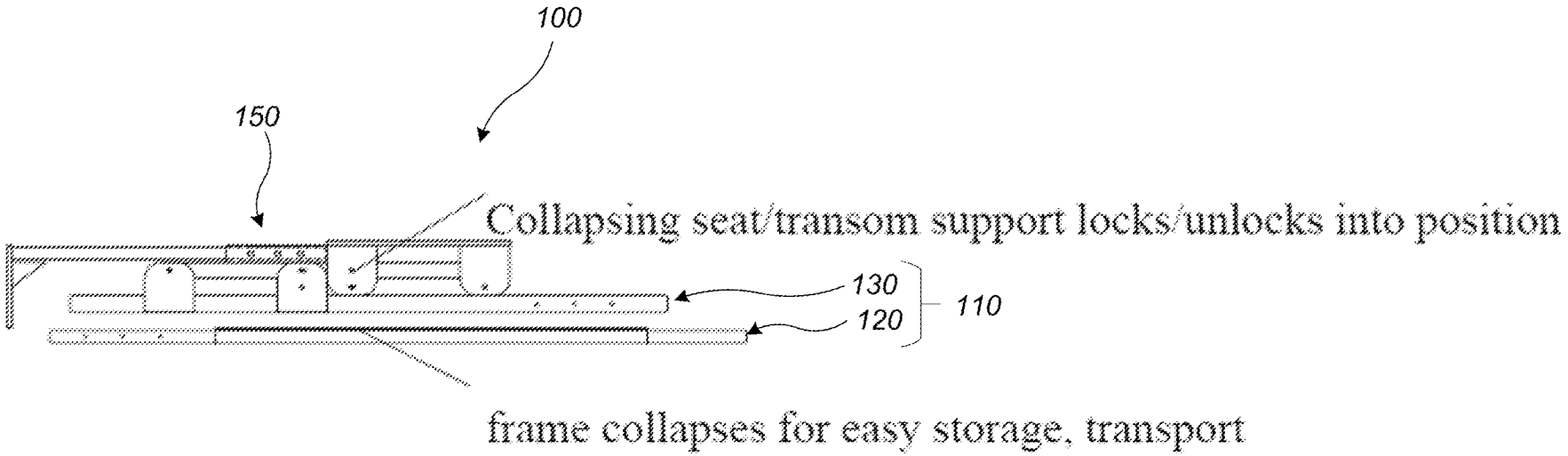
FIG. 4 is a schematic side view of the transom in a collapsed state.

This configuration permits the connection struts 170 to rotate (as shown by arrow A in FIG. 2) so that the support portion 140 is movable between an expanded position with the support portion 140 spaced away from the floor 110 to a collapsed position (as shown in FIG. 4) in which the support portion 140 is adjacent or contacts the floor 110. Pins 172 can be inserted through holes in the connection struts and flanges to lock the support portion in the expanded position. Alternatively or in addition, the pivotal connections can use spring loaded to urge the support portion into the expanded position. In some implementations, the spring loading is configured to have its highest compression at a midpoint such that the struts are urged stay in the expanded and collapsed positions. In some implementations, the connection struts include tabs to friction lock onto the struts of the floor 110 and support portion 140.

Returning again to FIG. 1, when the support portion 140 is in the expanded position the top cover 152 of the support portion 150 can provide a seat for the operator. In addition, the space below the cover can be used for storage, e.g., for a gas tank or battery.

Optionally a floorboard can secured to the transom 100. For example, the floorboard can be fabricated as a set of slats, connected at edges by rope or the like, such that the floorboard can be rolled up for storage or transport. The slats can be plastic, plywood, etc. In use, the floorboard can be placed on the transom in the inflated raft, unrolled, and then secured, e.g., by screws that fit through holes in the slats into receiving holes in the struts of the transom.

A number of embodiments have been described. Nevertheless, it will be understood that various modifications may be made without departing from the spirit and scope of the invention. Accordingly, other embodiments are within the scope of the following claims.

What is claimed is:

1. A collapsible transom for an inflatable raft, the transom comprising:

a front section including two parallel front struts; and a rear section including a floor portion and a collapsible support portion, the floor portion including two parallel rear struts and wherein the two parallel front struts and two parallel rear struts slidably connectable to each other by insertion into tubular end portions, the support portion pivotally connected to the floor portion and movable between an expanded position with the support portion substantially parallel to and spaced away from the floor to a collapsed position with the support portion adjacent the floor.

2. The collapsible transom of claim 1, wherein the support portion includes a fore section and an aft section that are slidably connected such that the aft section is horizontally movable relative to the fore section.

3. The collapsible transom of claim 2, aft section is extendible to project past an aft end of the floor portion.

4. The collapsible transom of claim 3, wherein the aft section of the support portion is configured for connection to an outboard motor.

5. The collapsible transom of claim 2, wherein the fore section of the support portion comprises a top cover to provide a seat when the support portion is in the expanded position.

6. The collapsible transom of claim 2, wherein the fore section includes two parallel fore struts and the aft section includes two parallel aft struts with the fore struts and aft struts slidably connectable to each other by insertion into second tubular end portions.

7. The collapsible transom of claim 6, comprising spring-loaded pins to fit into holes in the second tubular end portions to lock the two parallel fore struts relative to the two parallel aft struts.

8. The collapsible transom of claim 1, wherein the support portion is connected to the floor portion of the rear section by a plurality of parallel connection struts.

9. The collapsible transom of claim 8, wherein the plurality of parallel connecting struts comprise four connection struts each having a first end connected to the floor portion and a second end connected to the support portion.

10. The collapsible transom of claim 9, wherein the four connection struts are connected to the floor portion at points that define a rectangle.

11. The collapsible transom of claim 8, comprising loading springs configured to urge the support to the collapsed position.

12. The collapsible transom of claim 8, comprising loading springs configured to urge the support to the expanded position.

13. The collapsible transom of claim 8, comprising tabs on the connection struts or on struts of the support to lock the connection struts in the expanded position.

14. The collapsible transom of claim 8, comprising pins to fit through aligned holes in the connection struts and the floor and support to lock the connection struts in the expanded position.

15. The collapsible transom of claim 8, wherein the plurality of parallel connection struts extend perpendicular to the two parallel front struts when the support is in the expanded position.

16. The collapsible transom of claim 15, wherein the plurality of parallel connection struts extend parallel to the two parallel front struts when the support is in the collapsed position.

17. The collapsible transom of claim 1, wherein end portion of the two parallel rear struts fit into tubular end portions of the two parallel front struts.

18. The collapsible transom of claim 1, wherein end portion of the two parallel front struts fit into tubular end portions of the two parallel rear struts.

19. The collapsible transom of claim 1, comprising spring-loaded pins to fit into holes in the tubular end portions to lock the two parallel front struts relative to the two parallel rear struts.

20. The collapsible transom of claim 1, further comprising a rollable deck configured for attachment to the front section and the floor portion of the rear section.

* * * * *